United States Patent [19]

Bull et al.

[11] Patent Number: 4,535,672

[45] Date of Patent: Aug. 20, 1985

[54] APPARATUS FOR MOUNTING COMPONENTS FOR ROTATION OF CARRIERS FOR STRAND SUPPLY BOBBINS AND FOR TIMING STRAND MOVEMENT RELATIVE TO ROTATION

[75] Inventors: Jeffrey F. Bull, Akron; Michael E. Winiasz, Lorain, both of Ohio

[73] Assignee: James F. Karg, Akron, Ohio

[21] Appl. No.: 673,382

[22] Filed: Nov. 20, 1984

[51] Int. Cl.[3] ..... D04C 3/06; D04C 3/24; D04C 3/40

[52] U.S. Cl. ..... 87/29; 87/16; 87/33; 87/44

[58] Field of Search ..... 87/29, 30, 32–34, 87/44–48, 14–17

[56] References Cited

U.S. PATENT DOCUMENTS 1,493,782 5/1924 Klein ..... 87/44
1,981,377 11/1934 Standish ..... 87/47
3,756,117 9/1973 De Young ..... 87/29
3,802,312 4/1974 Brand ..... 87/33 X
4,304,169 12/1981 Cimprich et al. ..... 87/29

*Primary Examiner*—John Petrakes
*Attorney, Agent, or Firm*—Mack D. Cook, II

[57] ABSTRACT

A mounting assembly for the central axis stationary shaft and power input shaft of a braiding machine having a set of strand carriers mounted on the rear side of a first table, another set of strand carriers movable around the front side of the first table for rotation by a second table, and a drive mechanism for rotating the tables in opposite directions. The mounting assembly has a frame base, a frame stanchion for mounting the central axis stationary shaft and having a medial lattice opening, a drive torque tube extending from the lattice opening and housing and rotatably mounting the power input shaft, and, an arcuately adjustable means projecting into the lattice opening for support of the rear end of the drive torque tube.

5 Claims, 4 Drawing Figures

APPARATUS FOR MOUNTING COMPONENTS FOR ROTATION OF CARRIERS FOR STRAND SUPPLY BOBBINS AND FOR TIMING STRAND MOVEMENT RELATIVE TO ROTATION

BACKGROUND OF THE INVENTION

The invention relates generally to an improved strand fabricating machine.

More specifically, the invention relates to an apparatus for mounting of components for rotation of sets of front and rear carriers for strand supply bobbins and for timing movement of strands from a set of rear bobbins relative to contra-rotation of the carriers for the front bobbins.

A fair description of a strand fabricating machine, also known in the prior art as a braiding machine, is found in U.S. Pat. No. 1,493,782, 1924, Klein. Reference is made "to that type of machine in which two oppositely rotating tables or turrets are provided, each turret or table carrying a series of spools or bobbins, the threads from all of said spools converging at a braiding point above the machine and means being provided whereby the threads from one series of bobbins will be interlaced with the threads from the other series of bobbins. The purpose of machines of this type is to produce a tubular braided fabric with or without a core." (col. 1, 11. 9–21)

The prior art braiding machines with two oppositely rotating tables, have presented the prior inventors with an inherent design problem. As illustrated by FIG. 2, of the Klein patent, any such braiding machine will have a central axis stationary shaft, such as element 2, which mounts the oppositely rotating tables. Power to rotate the tables cannot be transmitted through the stationary shaft centerline because that space is reserved for passage of the core being braided. Therefore, there must be a separate power input shaft.

The prior art solutions to the separate power input shaft requirements for braiding machines having first and second tables rotating about a central axis stationary shaft have led to inherently complex and precisely machined power transmission systems and similarly complex machine bases, frames or support structures. The Klein patent shows a base 1 mounting a horizontal drive shaft 3 carrying a pulley 4 at its outer end adapted to be engaged by a suitable clutch 5 to connect the driving pulley to the drive shaft. A bevelled driving pinion 6 is mounted on the inner end of the drive shaft and engages two bevelled gears 7 and 8 for rotating the bobbin carrying plates in opposite directions. U.S. Pat. No. 1,981,377, 1934, Standish, also shows a precisely machined base 1 housing a pulley driven shaft 6 carrying a bevel pinion 8 meshing with drive gears 9 and 10. U.S. Pat. No. 3,756,117, 1973, DeYoung, shows a drive mechanism 25 including a stationary sun gear 26 and sets of planet gears 29, 30 and 31 carried by a support plate 27.

So far as is known to the inventors, the art relating to braiding machines having two oppositely rotating tables mounted on a central axis stationary shaft has not had a relatively uncomplex base, frame or support structure for mounting a power input shaft for a drive mechanism for rotating the two tables at the same speed but in opposite directions.

Another problem existent with prior art braiding machines having two oppositely rotating tables, each table carrying a set or series of spools or bobbins, has been providing for selective adjustment of the timing of movement of strand of material from a set of rear or lower bobbins, along the central axis of the braiding machine, relative to contra-rotation of a set of front or upper bobbin carriers. The passage of the rear strands between any two carriers for the front bobbins, must occur within the dimensions of a relatively small "window." The timing of rear strand passage through the "window" between the contra-rotating front bobbin carriers should be adjustable. An efficient braiding machine should be able to run with strand materials of varied composition or different outer diameters. A limited timing adjustment will optimize the operating conditions for any one particular form of strand material.

Prior art braiding machines known to the inventors have had no easy means of changing timing between rear strand movement and the position of a passing front strand carrier. Timing changes have required disassembly of portions of the braiding machine and reassembly in different positions. Also, timing could never be changed while the braiding machine was operating.

SUMMARY OF THE INVENTION

It is an object of the invention to provide an improved strand fabricating machine.

It is a further object of the invention to provide an improved apparatus for mounting of components for rotation of sets of front and rear carriers for strand supply bobbins and for timing movement of strands from a set of rear bobbins relative to contra-rotation of the carriers for the front bobbins.

Still further, it is an object to provide a mounting for braiding machine components, including a central axis stationary shaft and a power input shaft, which is relatively uncomplex; leading to lower costs of fabrication and efficiencies in operation and maintenance.

Still further, it is an object to provide for selective adjustment of the timing of movement of strand material from a set of rear bobbins, along the central axis of the braiding machine, relative to contra-rotation of a set of front bobbin carriers; without requiring disassembly of portions of the braiding machine or while the braiding machine is operating.

These and other objects of the invention, as well as the advantages thereof, will become apparent in view of the drawings and the detailed description.

The invention is used with a braiding machine having a set of rear carriers for a strand supply bobbin mounted on the rear side of a first table for rotation in one direction. The braiding machine also has a set of front carriers for a strand supply bobbin movable around the front side of the first table for rotation by a second table in the opposite direction. The braiding machine has a central axis stationary shaft for rotatable mounting of the first and second tables thereon. The braiding machine also has a power input shaft for connection to a drive mechanism for rotating the first and second table in opposite directions.

An assembly according to the invention, for mounting the central axis stationary shaft and the power input shaft, has a frame base. A vertically oriented frame stanchion is carried by the frame base and has an upper end for attachment of the rear end of the central axis stationary shaft. The frame stanchion has a medial lattice opening below the upper end. A drive torque tube extends from within the frame stanchion medial lattice opening and substantially parallel to the central axis stationary shaft and toward the rear side of the first table. The torque tube houses and rotatably mounts the power input shaft. An arcuately adjustable means projects into the frame stanchion medial lattice opening for support of the rear end of the drive torque tube.

The braiding machine may also have a control element positioned around the central axis stationary shaft and behind the rear side of the first table and radially inwardly of the set of rear carriers for a strand supply bobbin. The front end of the drive torque tube is securely connected to the control element. Movement of the arcuately adjustable means supporting the rear end of the drive torque tube will move the control element for timing movement of strands from a set of rear carriers for a strand supply bobbin relative to contra-rotation of the set of front carriers for a strand supply bobbin.

IN THE DRAWINGS

DETAILED DESCRIPTION OF THE INVENTION

Figure 1:
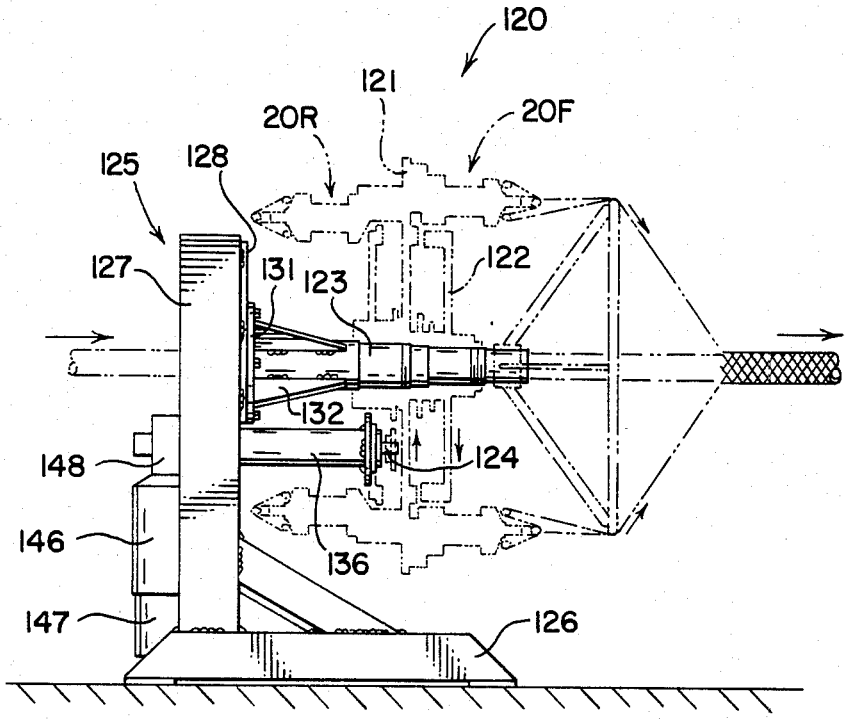
FIG. 1 is a side view of a braiding machine showing the mounting assembly according to the invention in full lines, other components of the braiding machine being shown in chain lines.
Figure 2:
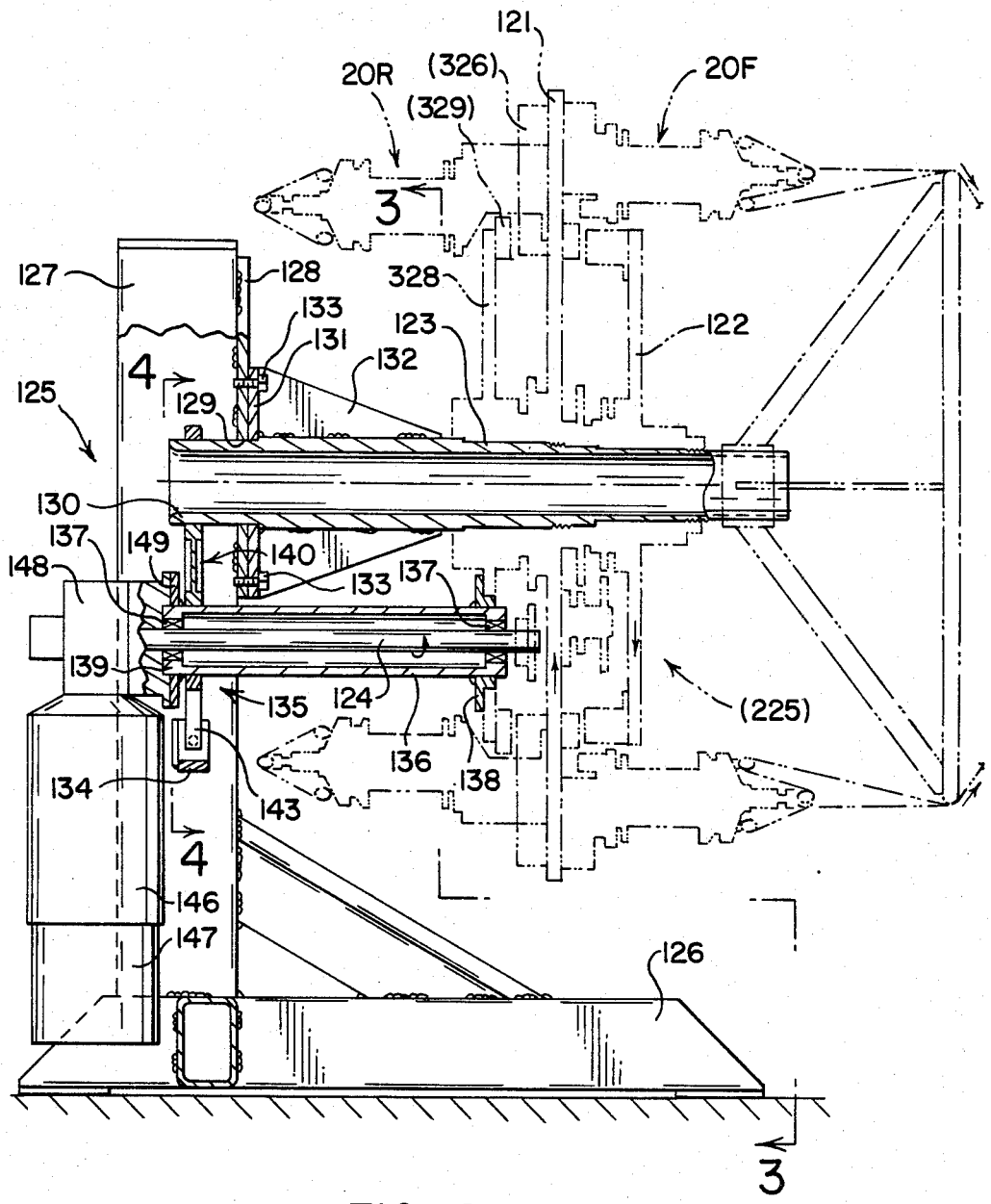
FIG. 2 is an enlarged side view, in section, showing details of a mounting assembly according to the invention.
Figure 3:
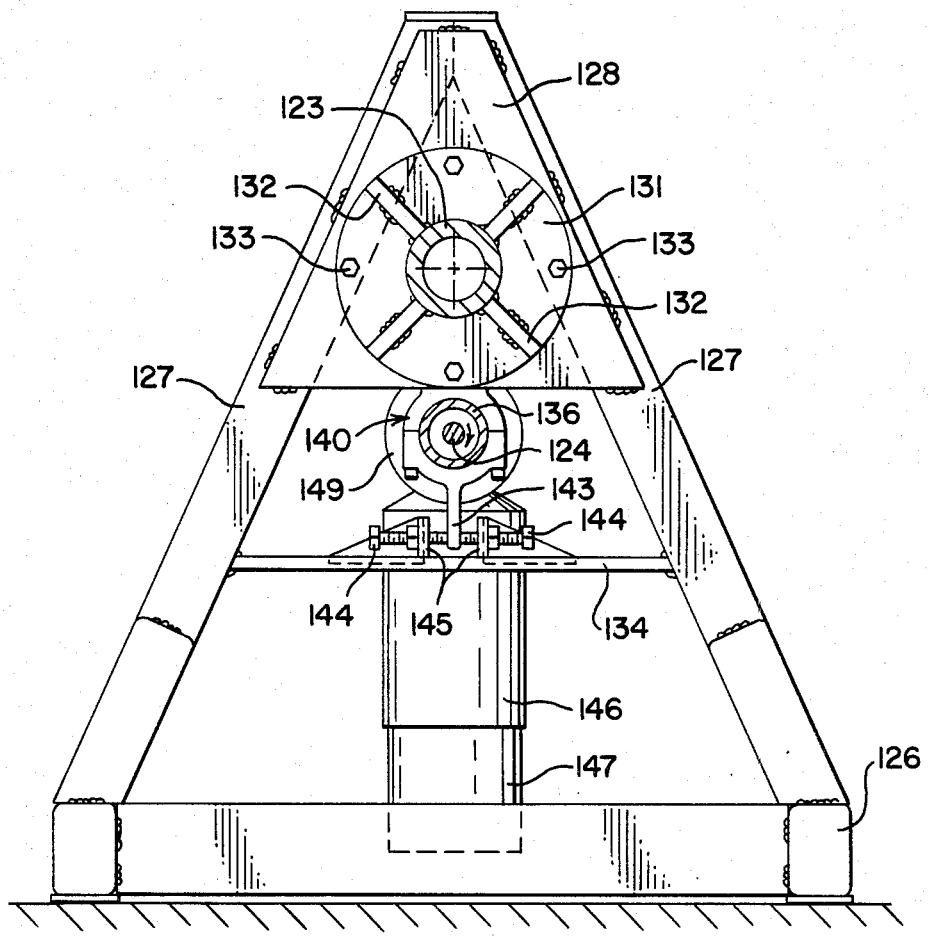
FIG. 3 is a front end view, taken substantially as indicated on line 3—3 of FIG. 2.
Figure 4:
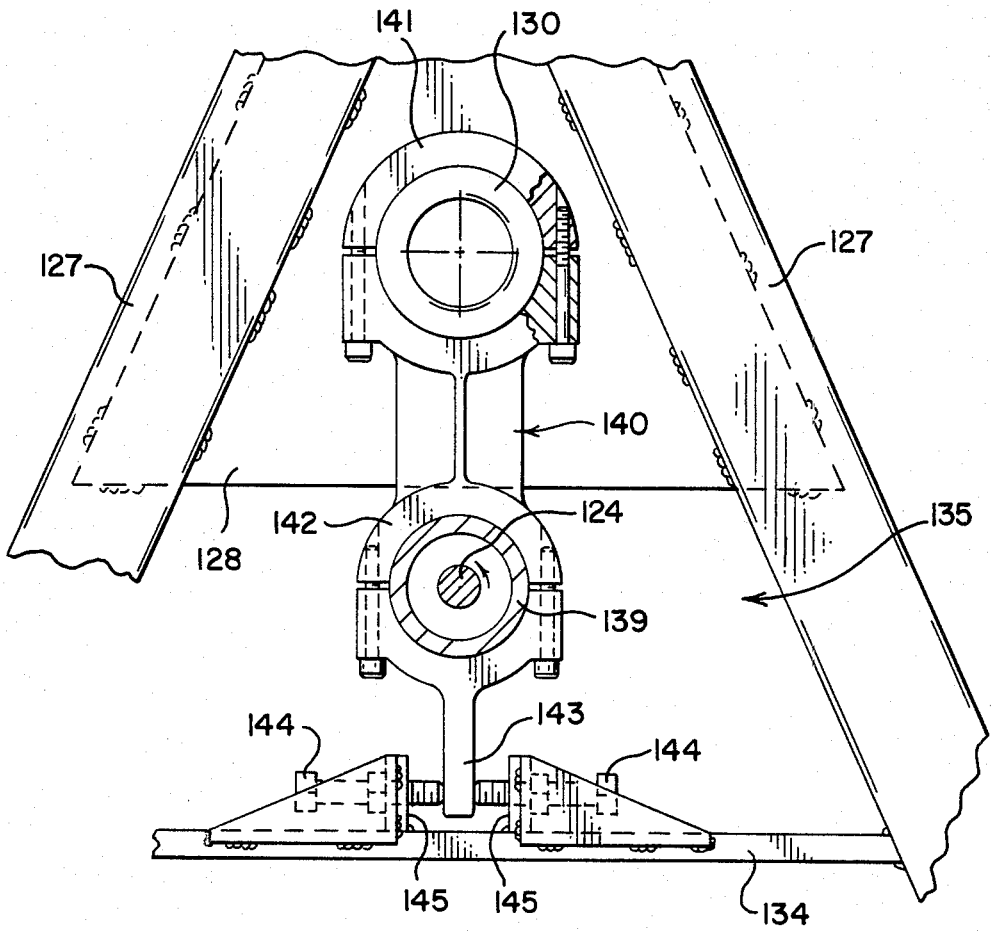
FIG. 4 is an enlarged fragmentary rear view, taken substantially as indicated on line 4—4 of FIG. 2.

A horizontal braiding machine, embodying the present invention, is referred to generally by the numeral 120. The braiding machine 120 will have a set of rear carriers 20R for a strand supply bobbin mounted on the rear side of a first table 121 for rotation in one direction. The braiding machine 120 will further have a set of front carriers 20F for a strand supply bobbin movable around the front side of the first table 121 for rotation by a second table 122 in the opposite direction. A stationary shaft 123 on the central axis of the braiding machine rotatably mounts the first table 121 and second table 122 thereon. A drive mechanism power input shaft 124 extends parallel to the stationary shaft 123 and toward the rear side of the first table 121.

The assembly according to the invention, for mounting of the central axis stationary shaft 123 and radial positioning of the power input shaft 124, is referred to generally by the numeral 125. The mounting assembly 125 includes a frame base 126 carrying a vertically extending frame stanchion 127.

Each set of carriers, 20R and 20F, for a strand supply bobbin are shown only by chain lines. A carrier 20 particularly suited for use on a braiding machine 120 may be as disclosed in (Case No. 1795) U.S. patent application Ser. No. 648,064, filed Sept. 7, 1984, Bull et al., Carrier For A Strand Supply Bobbin. Reference is made to said patent application for such further details as may be required to more fully understand the nature of the invention.

A drive mechanism for selectively rotating the first table 121 and the second table 122 at the same speed but in opposite directions around the stationary shaft 123, in response to rotation of the power input shaft 124, is shown only by chain lines. A drive mechanism (225) particularly suited for use on a braiding machine 120 may be as disclosed in (Case No. 1793) U.S. patent application Ser. No. 673,383, filed Nov. 20, 1984, Winiasz, Apparatus For Rotation Of Carriers For A Strand Supply Bobbin. Reference is made to said patent application for such further details as may be required to more fully understand the nature of the invention.

The upper end of the vertically extending frame stanchion 127 is for attachment of the base end of the central axis stationary shaft 123. As shown, the upper end of frame stanchion 127 has an integral face plate 128 with a bore 129 for positioning a rearwardly projecting end or base 130 of the stationary shaft 123. A shaft support plate 131, having a series of lateral webs 132 securely connected to the stationary shaft 123, is detachably connected to the stanchion face plate 128 coaxially around the face plate bore 129, as by fastening bolts 133. Below the face plate 128, the frame stanchion 127 has a horizontal shelf flange 134. The area between the face plate 128 and the shelf flange 134, below the upper end of the frame stanchion 127, provides a frame stanchion medial lattice opening, indicated at 135.

The mounting assembly 125 further includes a drive torque tube 136. The torque tube 136 extends laterally from within the frame stanchion medial lattice opening 135 and substantially parallel to the central axis stationary shaft 123 and toward the rear side of the first table 121. The torque tube 136 houses and rotatably mounts the power input shaft 124, as by dual roller bearing assemblies 137. The front end of torque tube 136 is securely connected, as indicated at 138, to a control element 328.

Control element 328, positioned around the central axis stationary shaft 123 and behind the rear side of the first table 121 for carrying and positioning a cam track (329) radially inwardly of the rear carriers 20R, is adjustably rotated for use with a set of mechanisms (326) for guiding strands from bobbins on the rear carriers 20R through an arc segment relative to the central axis of the braiding machine 120, over and around moving strands from bobbins on the front carriers 20F. An embodiment of control element 328 and strand guiding components functioning in combination therewith may be as disclosed in (Case No. 1792) U.S. patent application Ser. No. 673,384, filed Nov. 20, 1984, Bull, et al., Apparatus For Control Of Moving Strands From Rotating Strand Supply Bobbins. Reference is made to said patent application for such further details as may be required to more fully understand the nature of the invention.

The mounting assembly 125 further has an arcuately adjustable means projecting into the frame stanchion medial lattice opening 135 for support of the rearwardly projecting end or base 139 of the drive torque tube 136 and to adjustably position the control element 328 radially of the central axis stationary shaft 123 for timing movement of strands from a set of rear carriers 20R along the central axis of the braiding machine 120 relative to contra-rotation of the moving strands from a set of front carriers 20F.

As shown, a pitman hanger indicated at 140 interconnects the stationary shaft end 130 and the drive torque tube end 139. The upper end of a pitman hanger 140 has a tightenable clamp ring 141 for securely engaging the shaft end 130. The medial portion of a pitman hanger 140 has a tightenable clamp yoke 142 for securely engaging the tube end 139. The lower end of a pitman hanger 140 has a downwardly projecting lever 143. The pitman hanger lever 143 is selectively engaged for limited adjustable arcuate movement around the central axis of the braiding machine 120 by an adjustment means on the frame stanchion shelf flange 134. As shown, the adjustment means for the pitman hanger lever 143 may be opposed adjustment bolts 144 carried by opposed bolt mounting flanges 145 mounted on the frame stanchion shelf flange 134.

The power input shaft 124 is selectively rotated by a rear mounted drive motor 146 having an integral brake mechanism 147. The drive motor 146 also has an integral gear reduction drive unit 148 interiorly connected to the transversely extending input shaft 124. The motor 146 is vertically suspended by a mounting ring 149 securely connected to the drive torque tube 136 rearwardly of the pitman hanger 140.

What is claimed is:

1. In a braiding machine having a set of rear carriers for a strand supply bobbin mounted on the rear side of a first table for rotation in one direction, a set of front carriers for a strand supply bobbin movable around the front side of said first table for rotation by a second table in the opposite direction, a central axis stationary shaft for rotatable mounting of said first and second tables thereon, and a power input shaft for connection to a drive mechanism for rotating said first and second tables in opposite directions, a mounting assembly for said central axis stationary shaft and said power input shaft, said mounting assembly comprising: a frame base; a vertically extending frame stanchion carried by said frame base and having an upper end for attachment of the rear end of said central axis stationary shaft; said frame stanchion further having a medial lattice opening below said upper end; a drive torque tube extending from within said frame stanchion medial lattice opening and substantially parallel to said central axis stationary shaft and toward the rear side of said first table, said torque tube housing and rotatably mounting said power input shaft; and, an arcuately adjustable means projecting into said frame stanchion medial lattice opening for support of the rear end of said drive torque tube.

2. A braiding machine according to claim 1 which further has a control element positioned around said central axis stationary shaft and behind the rear side of said first table, and the front end of said mounting assembly drive torque tube is securely connected to said control element: whereby movement of said arcuately adjustable means supporting the rear end of said drive torque tube will move said control element for timing movement of strands from said set of rear carriers relative to contra-rotation of said set of front carriers for a strand supply bobbin.

3. A braiding machine according to claim 1, wherein the upper end of said vertically extending frame stanchion has an integral face plate with a bore for positioning a rearwardly projecting end of said central axis stationary shaft and a shaft support plate having a series of lateral webs securely connected to said stationary shaft is detachably connected to said stanchion face plate coaxially around said face plate bore.

4. A braiding machine according to claim 3 wherein said vertically extending frame stanchion has a horizontal shelf flange below said stanchion face plate, the area between said face plate and said shelf flange defining said frame stanchion medial lattice opening.

5. A braiding machine according to claim 4 which further has a control element positioned around said central axis stationary shaft and behind the rear side of said first table, and the front end of said mounting assembly drive torque tube is securely connected to said control element, and said arcuately adjustable means projecting into said frame stanchion medial lattice opening is a pitman hanger interconnecting said stationary shaft and said drive torque tube, said pitman hanger having a downwardly projecting lever selectively engaged for limited adjustable arcuate movement around the central axis of said braiding machine by an adjustment means on said frame stanchion shelf flange: whereby movement of said pitman hanger lever will move said control element for timing movement of strands from said set of rear carriers relative to contra-rotation of said set of front carriers for a strand supply bobbin.

* * * * *